US006695651B2

(12) United States Patent
Mase et al.

(10) Patent No.: US 6,695,651 B2
(45) Date of Patent: Feb. 24, 2004

(54) CONNECTOR

(75) Inventors: Tsuyoshi Mase, Yokkaichi (JP); Tsutomu Tanaka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/178,310

(22) Filed: Jun. 21, 2002

(65) Prior Publication Data

US 2002/0197915 A1 Dec. 26, 2002

(30) Foreign Application Priority Data

Jun. 22, 2001 (JP) ..... 2001-190202
Jun. 25, 2001 (JP) ..... 2001-191266

(51) Int. Cl.[7] ..... H01R 13/436
(52) U.S. Cl. ..... 439/752
(58) Field of Search ..... 439/752, 595

(56) References Cited

U.S. PATENT DOCUMENTS 5,468,162 A * 11/1995 Oda ..... 439/752
5,586,918 A * 12/1996 Chemin ..... 439/752
5,593,326 A * 1/1997 Listing ..... 439/752
5,769,664 A * 6/1998 Saito et al. ..... 439/752
5,997,364 A * 12/1999 Matsuoka et al. ..... 439/752
6,080,023 A * 6/2000 Meulemeester et al. .... 439/752
6,116,954 A * 9/2000 Ries ..... 439/752
6,234,848 B1 * 5/2001 Sikora et al. ..... 439/752
6,247,966 B1 * 6/2001 Klein et al. ..... 439/752

FOREIGN PATENT DOCUMENTS

JP 4-137474 5/1992

* cited by examiner

*Primary Examiner*—Gary Paumen
(74) *Attorney, Agent, or Firm*—Gerald E. Hespos; Anthony J. Casella

(57) ABSTRACT

A connector has a housing (10) with retainer (40). The retainer (40) is formed with second securing portions (50) for locking terminal fittings (30) from behind and a front wall (42) for holding the terminal fittings (30) at their front-limit positions by bringing the terminal fittings into contact therewith from behind. Thus, a distance along forward and backward or longitudinal directions between the front wall 42) and the second securing portions (50) does not vary even if the retainer (40) should shake with respect to the housing (10). This prevents the terminal fittings (30) from making loose movements in the inserting and withdrawing directions with respect to the retainer (40).

8 Claims, 16 Drawing Sheets

CONNECTOR

BACKGROUND OF THE INVENTION

1. Field of the Invention

The invention relates to a connector with a retainer for locking one or more terminal fittings.

2. Description of the Related Art

Japanese Unexamined Patent Publication No. 4-137474 discloses a connector with a housing that has opposite front and rear ends. Cavities extend through the housing from the rear end to the front end, and terminal fittings are inserted into cavities from behind. The terminal fittings are held at proper insertion positions by abutting front ends of the terminal fittings against a wall at the front end of the cavities. A retainer is mounted sideways in a retainer accommodating space in the housing and is brought into engagement with the terminal fittings from behind to hold the terminal fittings in the cavities.

A small clearance is defined between the outer surfaces of the retainer and the inner surfaces of the retainer accommodating space to ensure smooth mounting of the retainer. Since the retainer is mounted sideways into the housing, this clearance is defined around the front, rear, upper and bottom surfaces of the retainer. Thus, the retainer shakes slightly with respect to the housing in forward and backward directions. If the retainer is displaced backward, the terminal fittings can move forward and backward by a distance between the front-limit positions defined by the front wall of the housing and the locked positions defined by the retainer. A problem exists in that the positions of the respective terminal fittings vary individually along forward and backward directions.

The present invention was developed in view of the above problem and an object thereof is to prevent terminal fittings from making loose movements in inserting and withdrawing directions with respect to a retainer.

SUMMARY OF THE INVENTION

The invention relates to a connector with a housing, at least one terminal fitting inserted into the housing from an insertion side and a retainer to be assembled with the housing. The retainer can engage the terminal fitting to prevent a properly inserted terminal fitting from coming out.

The retainer has an insertion stop for holding the terminal fitting at its insertion-limit position by contacting the terminal fitting from a side opposed to the terminal insertion side. The terminal fitting also has a securing portion for securing the terminal fitting from the terminal insertion side. A distance along between the insertion-stop and the securing portion does not vary even if the retainer shakes with respect to the housing. Thus, the terminal fitting will not move loosely in the inserting and withdrawing directions with respect to the retainer.

The terminal fitting preferably is inserted into the housing from behind, and the insertion-stop preferably is a front-stop that the terminal fitting contacts from behind.

The retainer may be formed integrally with the front-stop for holding the terminal fitting at its front-limit position by contacting the terminal fitting from the front and/or integrally with the securing portion for securing the terminal fitting by contacting the terminal fitting from behind. A distance along forward and backward directions between the front-stop and the securing portion does not vary even if the retainer shakes with respect to the housing. This prevents the terminal fitting from making loose movements in its inserting and withdrawing directions with respect to the retainer.

The retainer preferably is assembled with the housing, and is movable between a first position where the securing portion is retracted from an insertion path for the terminal fitting and a second position where the securing portion engages the terminal fitting from the terminal insertion side.

The insertion-stop may arranged such that the terminal fitting can contact the insertion-stop regardless of where the retainer is located between the first and second positions.

The insertion-stop preferably has a substantially flat surface substantially parallel with moving directions of the retainer between the first position and the second position.

The front-stop and the terminal fitting are in sliding contact when the retainer is moved from the first position to the second position. Thus, the front-stop and the terminal fitting do not catch one another as the retainer is moved.

Preferably, the securing portion and/or an engaging portion of the terminal fitting with which the securing portion is engaged have a slanted guide surface that extends oblique to the moving directions of the retainer between the first position and the second position.

The terminal fitting may be displaced back from a position where it contacts the front-stop. However, the slanted guide surface pushes the terminal fitting forward to the specified front-limit position and in contact with the front-stop as the retainer is moved.

The retainer preferably is in sliding contact with the housing and/or the terminal fittings when the retainer is moved between the first and second positions.

The housing preferably is formed inside with one or more locks for locking the terminal fittings in the housing. Additionally, the retainer preferably has one or more deformation preventing portions that engage the corresponding locks when the retainer is at the second position.

The deformation preventing portions and/or the locks preferably are formed with slanted guides that extend oblique to resiliently deforming directions of the locks and moving directions of the retainer between the first position and the second position.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
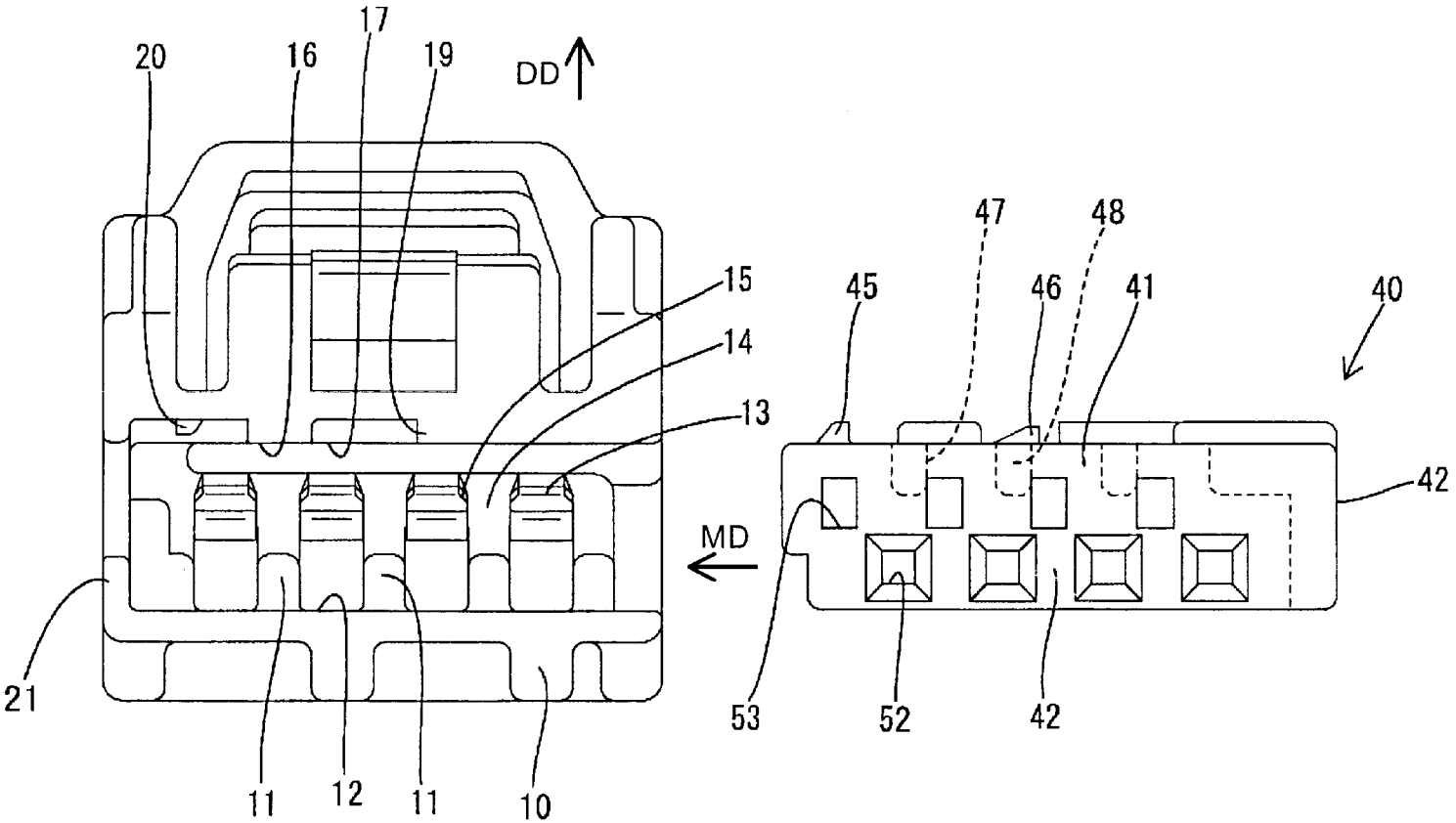
FIG. 1 is a front view showing a retainer detached from a housing in one embodiment of the present invention.
Figure 2:
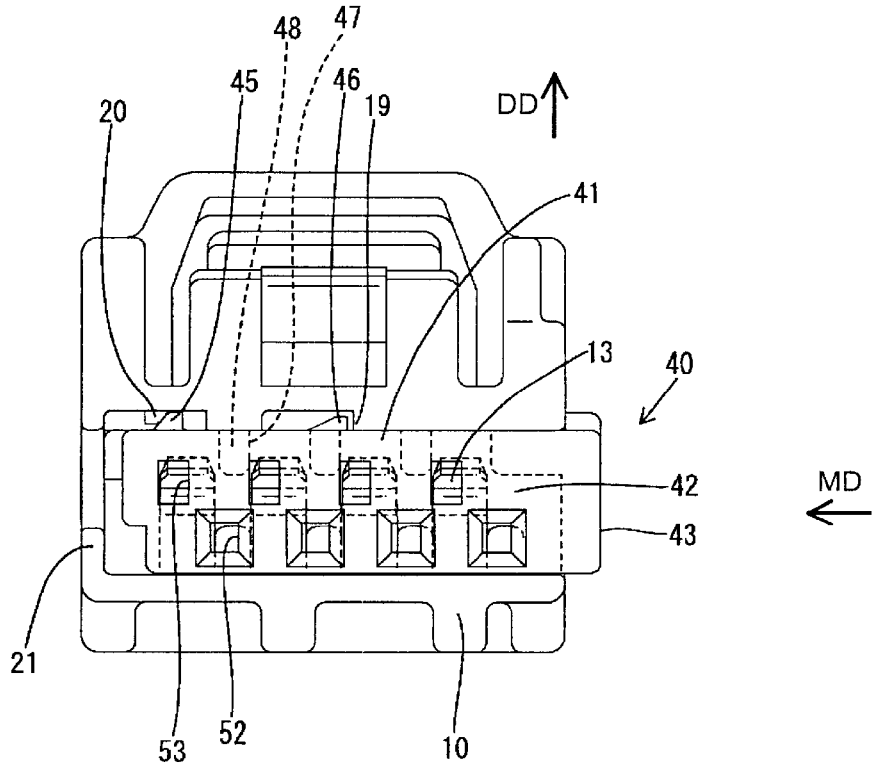
FIG. 2 is a front view showing the retainer mounted at a partial locking position in the housing.
Figure 3:
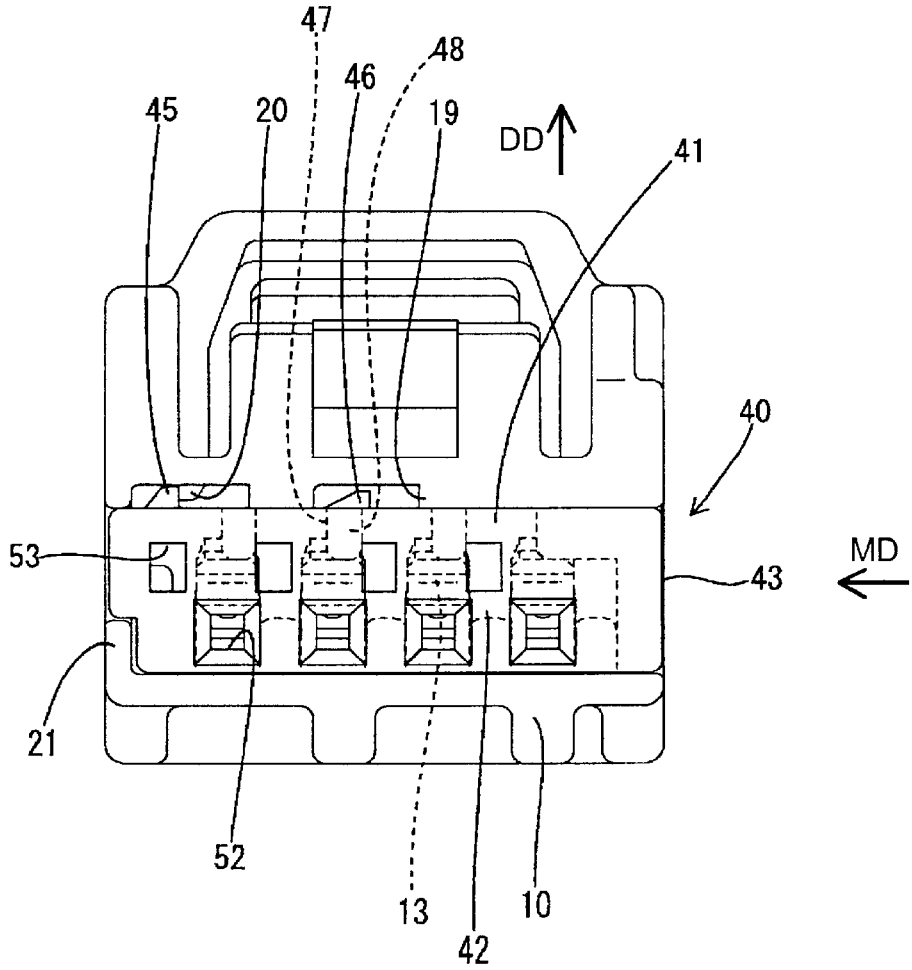
FIG. 3 is a front view showing the retainer at a full locking position in the housing.
Figure 4:
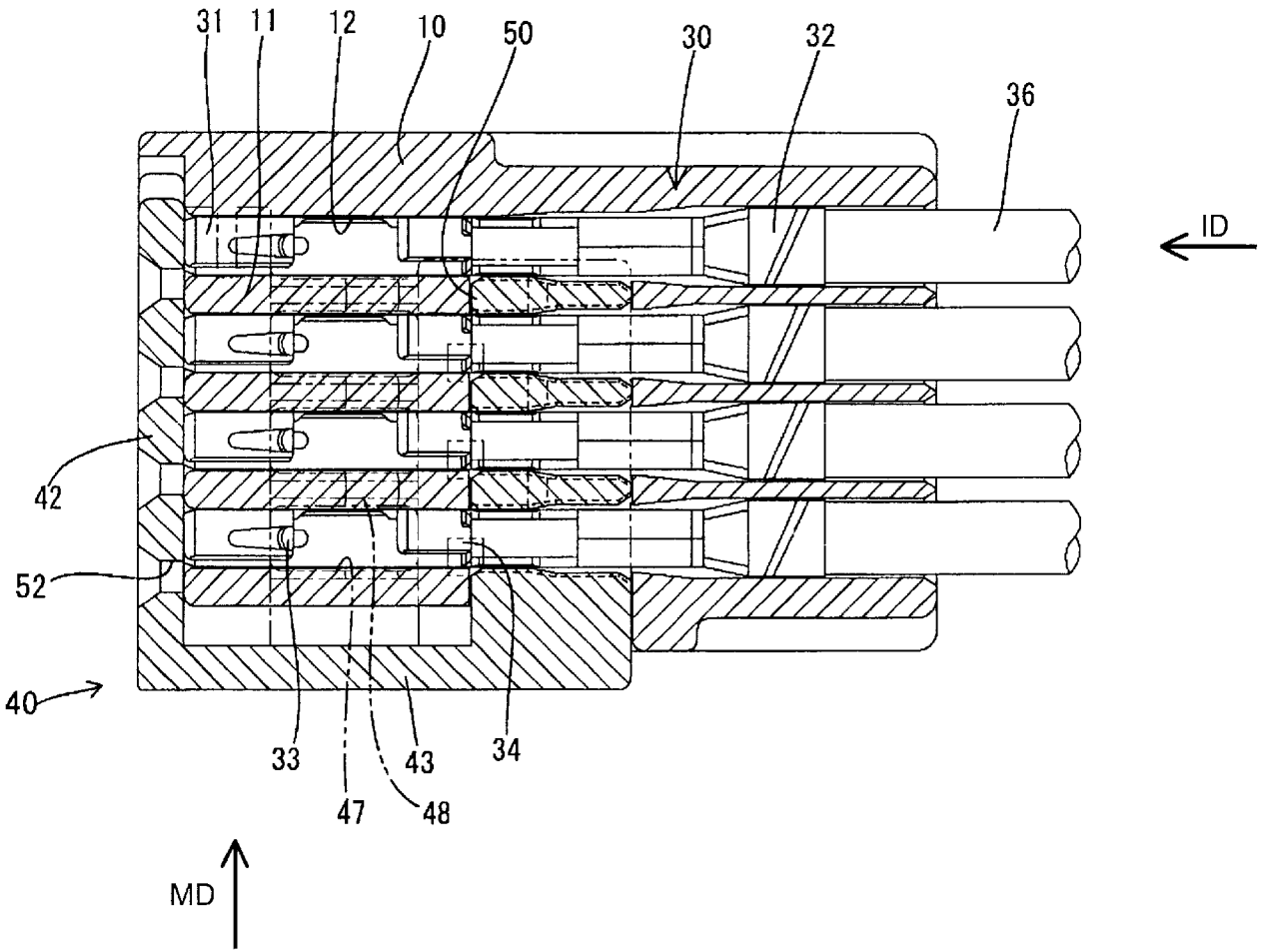
FIG. 4 is a horizontal section showing the retainer at the partial locking position in the housing.
Figure 5:
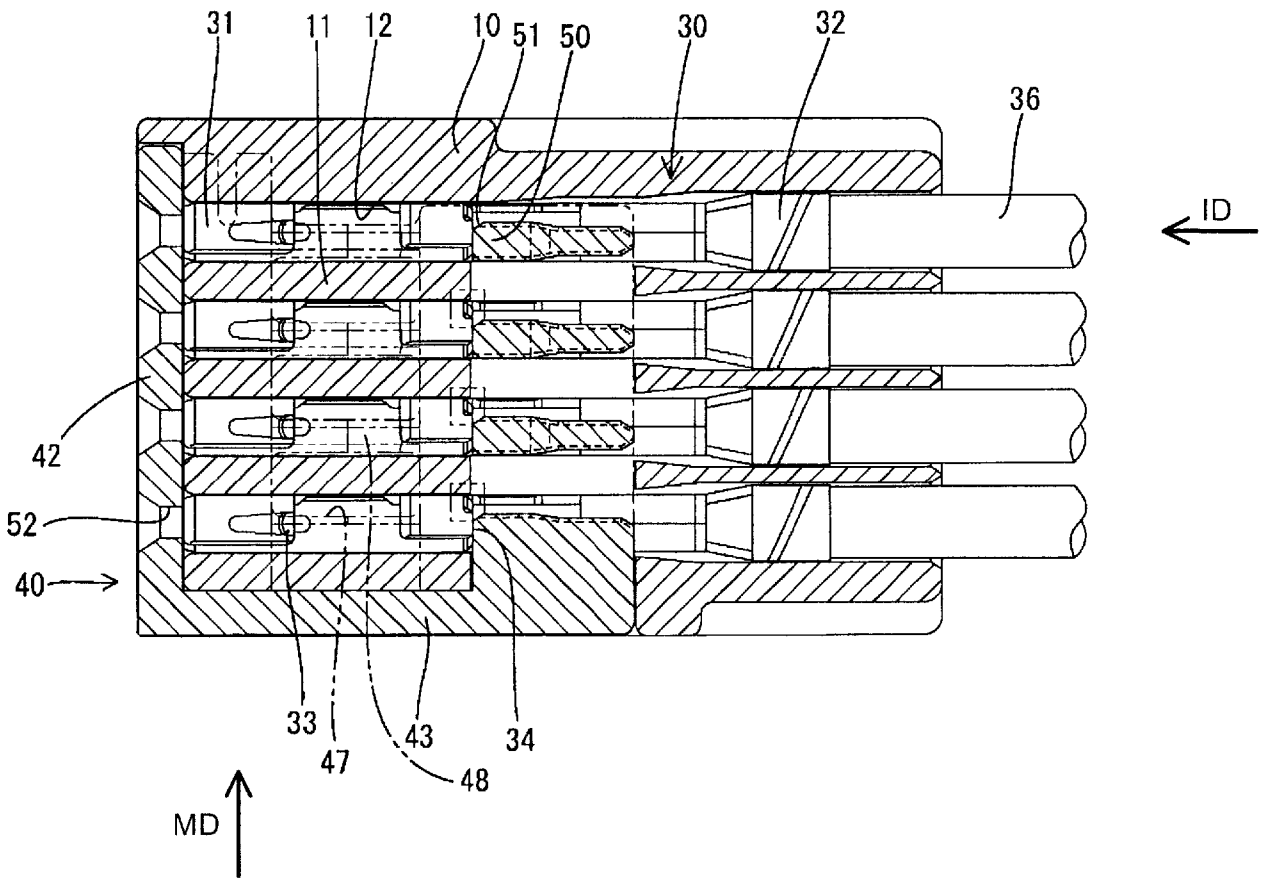
FIG. 5 is a horizontal section showing the retainer at the full locking position in the housing.
Figure 6:
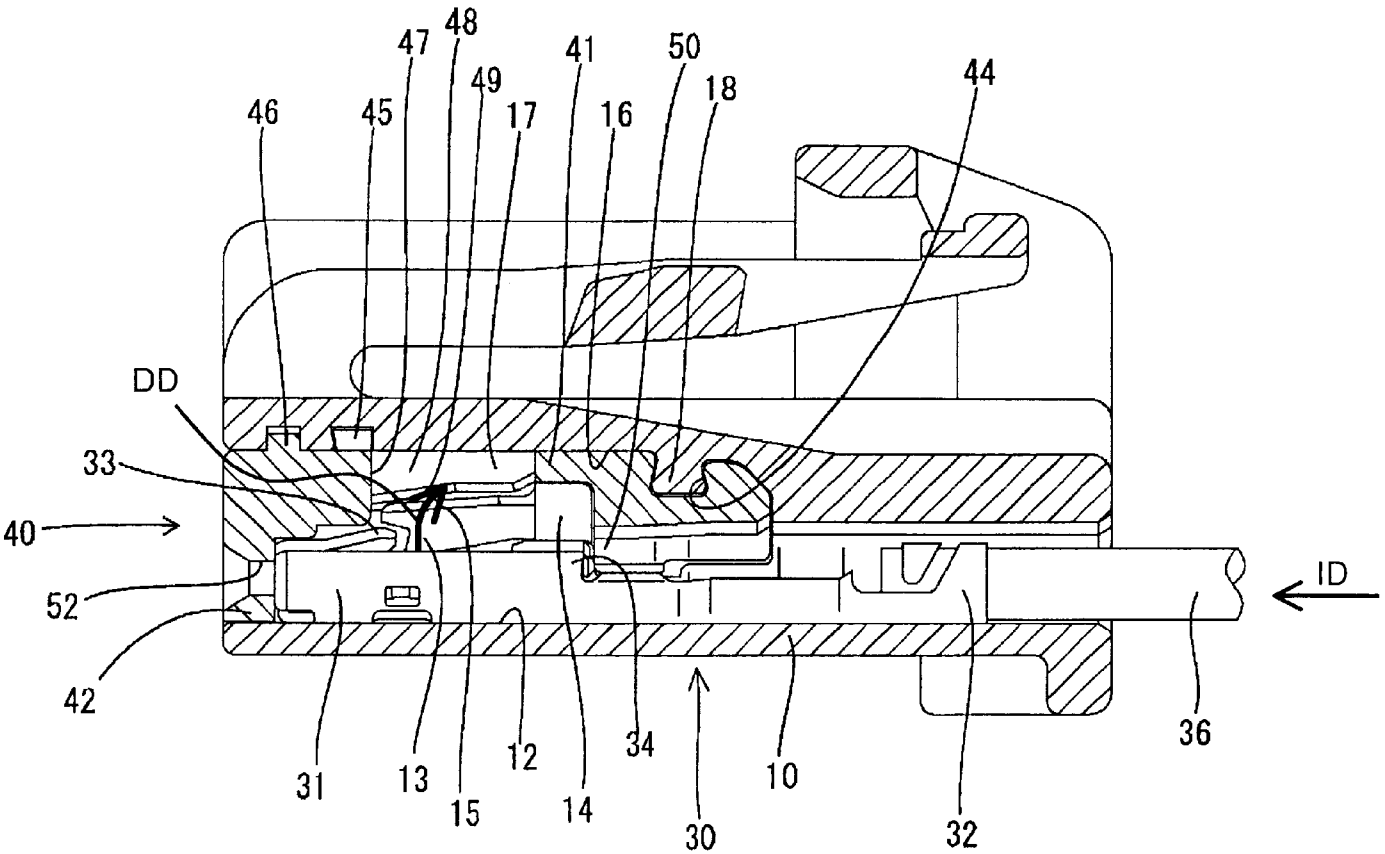
FIG. 6 is a vertical section showing a terminal fitting properly inserted in the housing.
Figure 7:
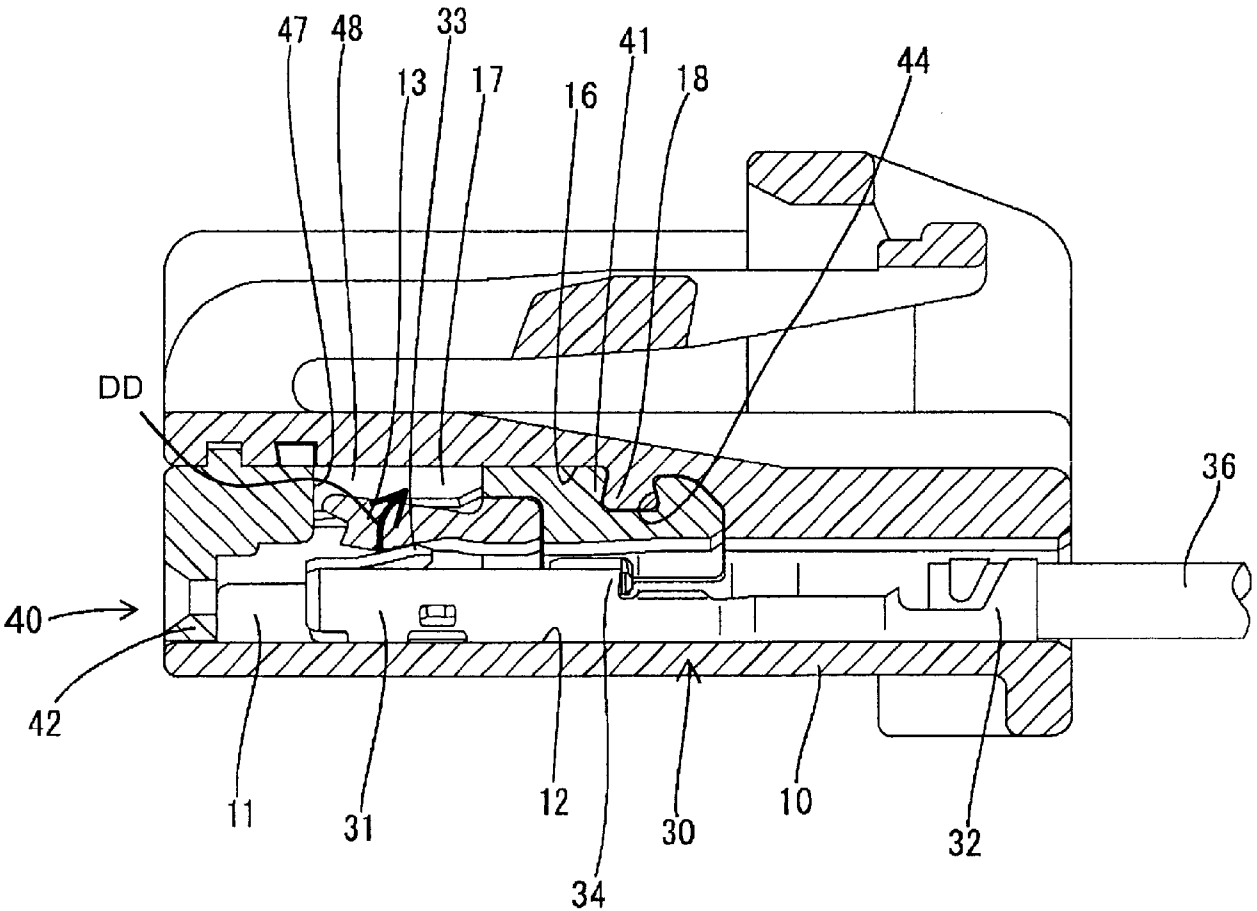
FIG. 7 is a vertical section showing an intermediate stage of insertion of the terminal fitting.
Figure 8:
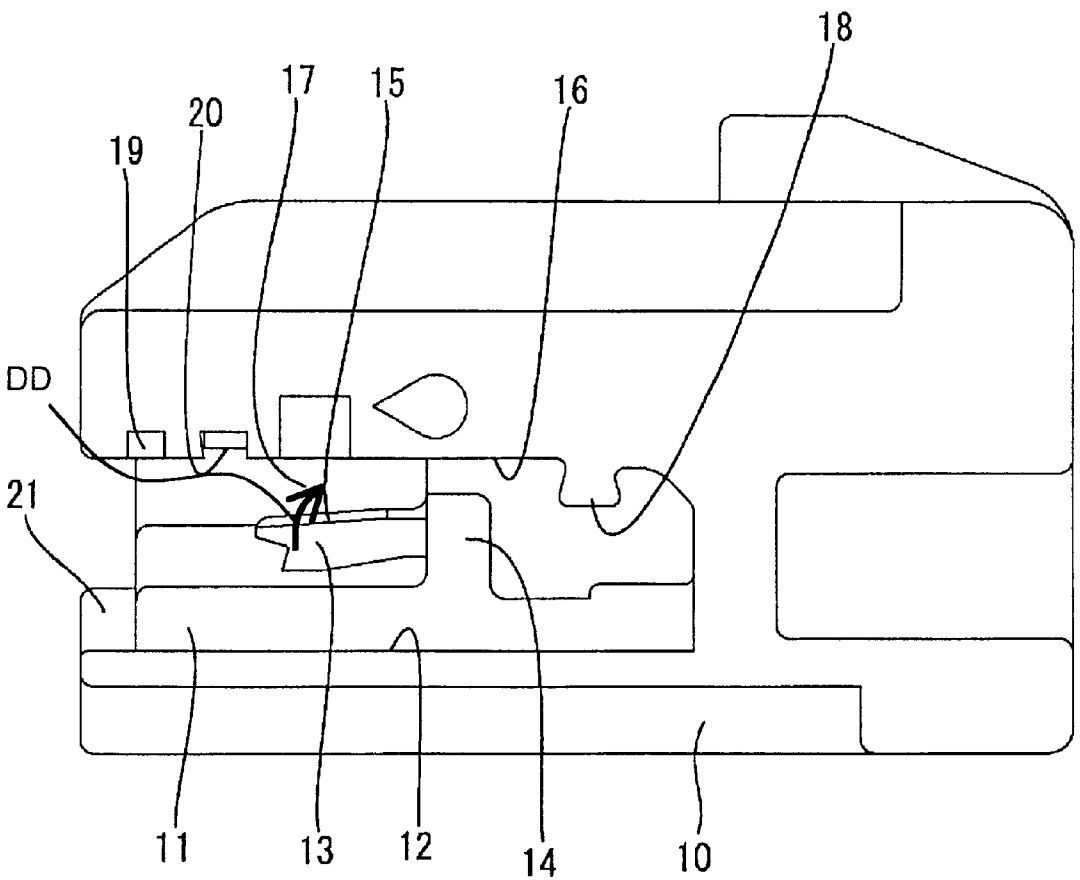
FIG. 8 is a side view of the housing.
Figure 9:
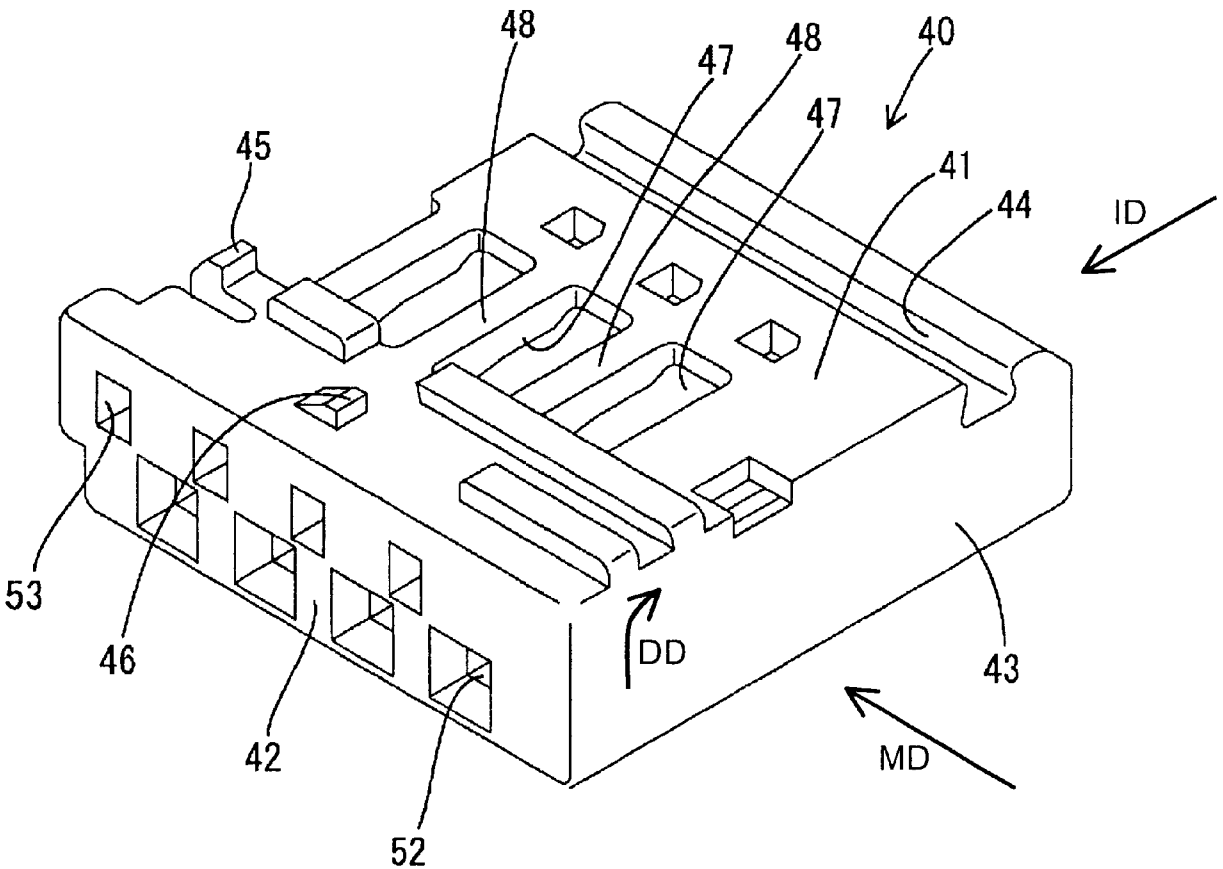
FIG. 9 is a perspective view of the retainer.
Figure 10:
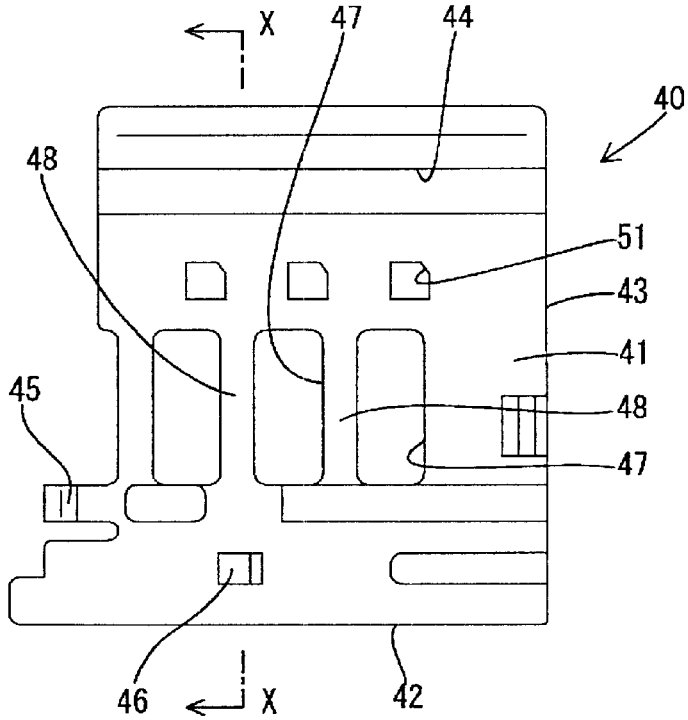
FIG. 10 is a plan view of the retainer.
Figure 11:
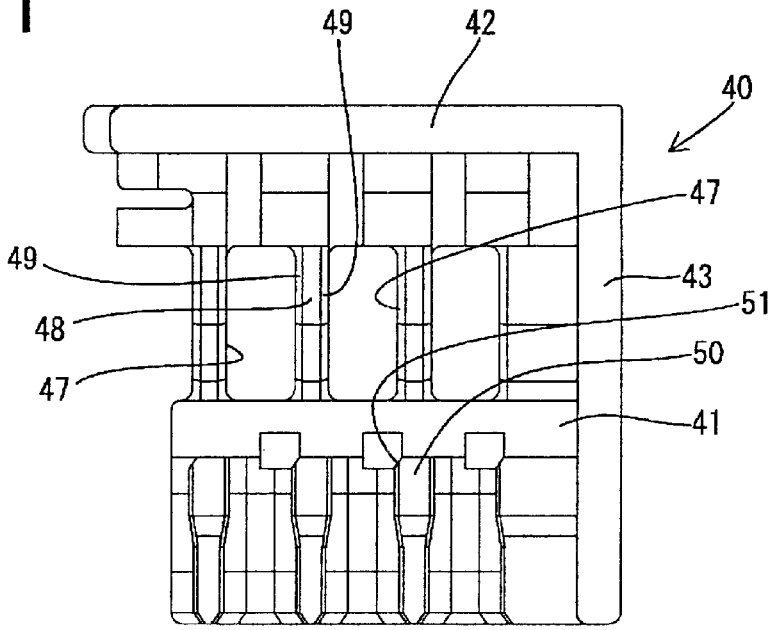
FIG. 11 is a bottom view of the retainer.
Figure 12:
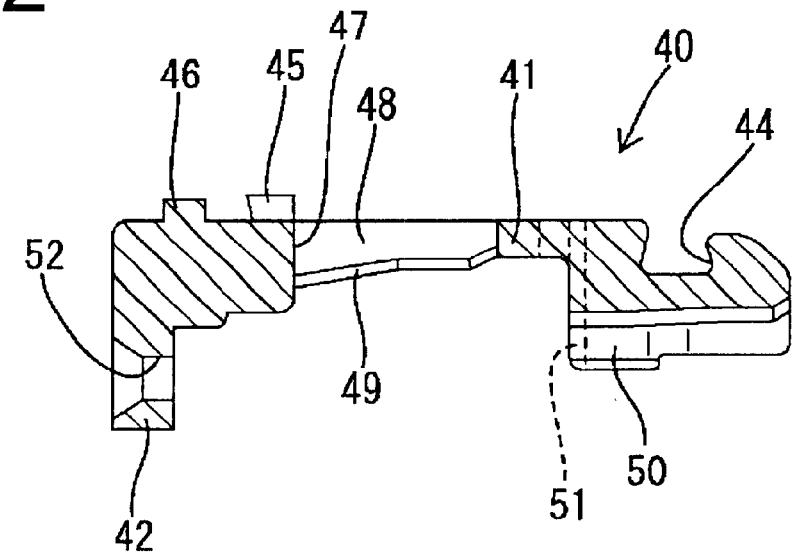
FIG. 12 is a section along 12—12 of FIG. 10.
Figure 13:
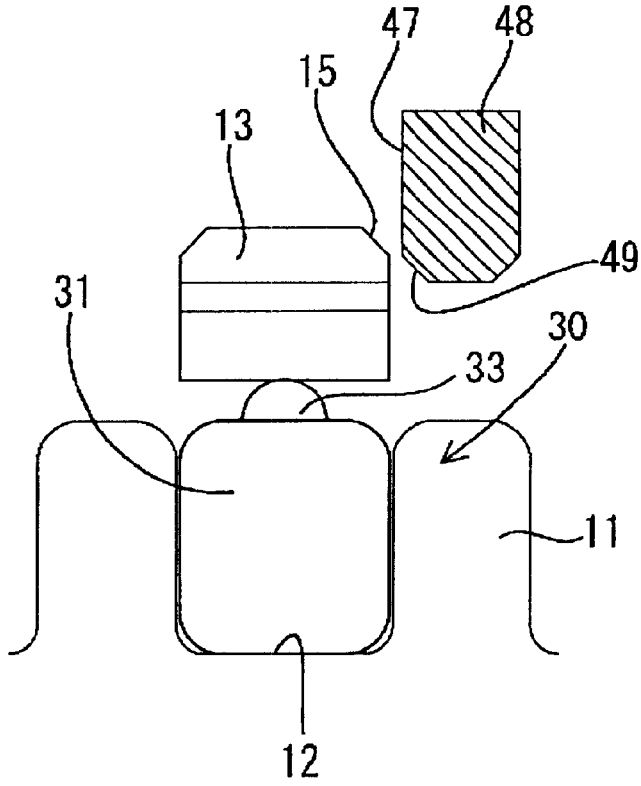
FIG. 13 is a horizontal section showing a positional relationship between the lock and the first securing portion at the intermediate stage of insertion of the terminal fitting.
Figure 14:
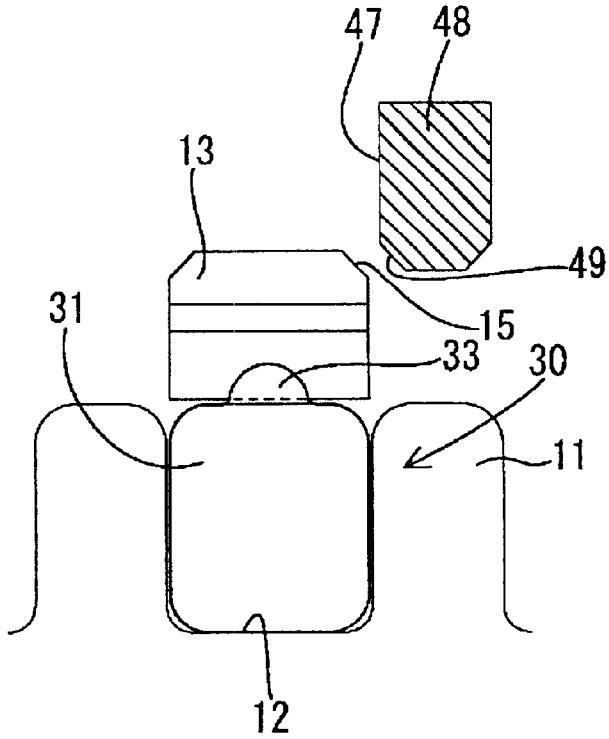
FIG. 14 is a horizontal section showing a positional relationship between the lock and the first securing portion where the lock is engaged with the properly inserted terminal fitting.
Figure 15:
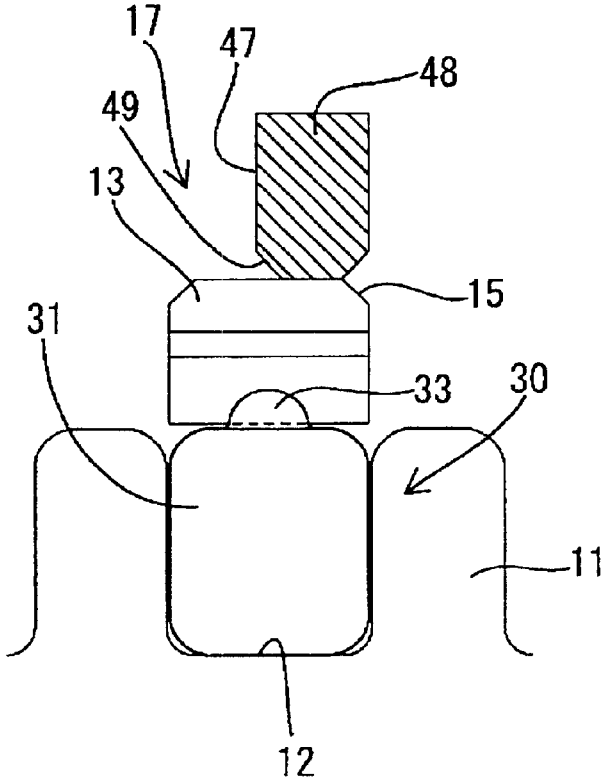
FIG. 15 is a horizontal section showing a positional relationship between the lock and the first securing portion where the first securing portion prevents the resilient deformation of the lock.
Figure 16:
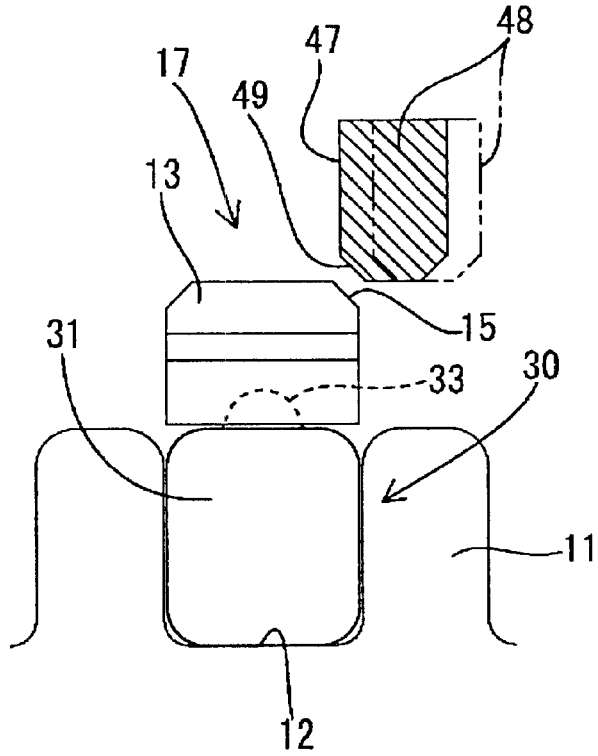
FIG. 16 is a horizontal section showing a positional relationship between the lock and the first securing portion where the retainer is displaced toward the full locking position from the partial locking position.

A connector according to the invention has a housing 10 made e.g. of a synthetic resin, one or more terminal fittings 30, and a retainer 40 made e.g. of a synthetic resin, as shown in FIGS. 1 to 22. In the following description, the left side in FIGS. 4 to 8 is referred to as front side, the bottom side in FIGS. 4 and 5 is referred to as left side, and reference is made to FIGS. 1 to 3, 6 and 7 concerning the vertical direction.

The housing 10 has partition walls 11 that define side-by-side cavities 12, and a lock 13 is formed in each cavity 12. Each lock 13 projects forward from a bridge 14 that stands up from the bottom surface of each cavity 12 and extends between the upper ends of the partition walls 11. Each lock 13 is supported at one end, and is resiliently deformable along the vertical direction. A slanted guide surface 15 is on the left end of the upper surface of each lock 13 (see FIGS. 1 and 13 to 18) and extends oblique to moving directions MD of the retainer 40 between partial and full locking positions and oblique to resiliently deforming directions DD of the lock 13.

A retainer accommodating space 16 is formed in the housing 10 above the cavities 12 and the locks 13 and is open in the left and front surfaces of the housing 10. A deformation permitting space 17 is defined in the retainer accommodating space 16 above each lock 13 and permits the lock 13 to deform resiliently out of an insertion path of the terminal fitting 30 at an intermediate stage of inserting the terminal fitting 30. Further, a transverse guide rib 18 is formed at a rear end of the ceiling surface of the retainer accommodating space 16, and a locking step 19 and a locking projection 20 are formed at a front end of the ceiling surface.

Each female terminal fitting 10 is narrow and long in forward and backward directions. A substantially rectangular tube 11 is formed at a front part of the terminal fitting 10 and a wire connecting portion 32 is at a rear part. The wire connecting portion can be crimped into connection with a wire 36. The rectangular tube 31 opens forward and has an internally disposed resilient contact piece (not shown) to be connected with a tab (not shown) of a male terminal fitting of a mating connector (not shown). A first engaging portion 33 is formed on the upper wall of the rectangular tube 31 by embossing a portion of the upper wall to have a substantially semicircular shape when viewed from the front. The first engaging portion 33 is engageable with the corresponding lock 13. A second securing portion 34 is at the rear edge of the upper wall of the rectangular tube 31 and is engageable with the retainer 40. A slanted guide surface 35 is formed at a left end (bottom end in FIGS. 4, 5, 19 to 22) of the second securing portion 34 and is oblique both to inserting and withdrawing directions ID of the terminal fitting 30 into and from the housing and to a mounting direction MD of the retainer 40 into the housing 10.

The retainer 40 has a substantially plate-shaped main body 41 that is insertable into the retainer accommodating space 16 and the deformation permitting spaces 17, a substantially rectangular mating side wall 42 that extends down from the front edge of the main body 41, and a left wall 43 that extends down from the left edge of the main body 41.

The retainer 40 can be fit into the retainer accommodating space 16 from the left side of the housing 10 and is transversely displaceable between a partial locking position (see FIGS. 2, 4, 13, 14, 19 and 20) and a full locking position (see FIGS. 3, 5, 15 and 22). A guide groove 44 at the rear end of the upper surface of the main body 41 engages the guide rib 18 of the housing 10 to guide movement of the retainer 40 in the moving direction MD and to prevent loose movements in forward and backward directions substantially normal to the moving direction MD. Thus, the front wall 42 is brought substantially into sliding contact with an opening edge in the front end surface of the housing 10, thereby preventing the retainer 40 from making loose vertical movements.

With the retainer 40 at the partial locking position, a first locking projection 45 and a second locking projection 46 at the front end of the upper surface of the retainer main body 41 engage the left surface of the locking projection 20 and the locking step 19 in the housing 10. Thus, the retainer 40 is prevented from making loose transverse movements along the moving direction MD with respect to the housing 10. With the retainer 40 displaced to the full locking position, the first locking projection 45 engages the right surface of the locking projection 20, and the right edge of the front wall 42 engages the left surface of a loose movement preventing portion 21 of the housing 10. Thus, the retainer 40 is prevented from making loose transverse movements.

The retainer main body 41 has escaping spaces 47 arranged substantially along the moving directions MD of the retainer 40. The escaping spaces 47 are through holes that penetrate the retainer main body 41 vertically and permit the locks 13 to deflect up (direction DD) by overlapping the deformation permitting spaces 17 when the retainer 40 is at the partial locking position. Beams between adjacent escaping spaces 17 in the retainer main body 41 serve as first securing portions 48. The beams 48 are narrow and long in forward and backward directions of the housing 10 and have both front and rear ends thereof supported on the retainer main body 41. The first securing portions 48 are retracted leftward and away from the deformation permitting spaces 17 when the retainer 40 is at the partial locking position so that the locks 13 can deform into the deformation permitting spaces 17. However, the first securing portions 48 enter the deformation permitting spaces 17 and contact the locks 13 from above when the retainer 40 is at the full locking position to prevent deformation of the locks 13 into the deformation permitting spaces 17. The right ends of the bottom surfaces of the first securing portions 48 are slanted to form slanted guide surfaces 49 (see FIGS. 13 to 18). The slanted guide surfaces 49 of the retainer 40 incline oblique to the moving directions MD of the retainer 40 between the partial locking position and the full locking position and oblique to the resiliently deforming directions DD of the locks 13, similar to the slanted guide surfaces 15 of the locking portions 13.

The bottom surface of the retainer main body 41 has step-shaped second securing portions 50 that are retracted leftward from the cavities 12 when the retainer 40 is at the partial locking position, and enter the cavities 12 to engage the second engaging portions 34 of the terminal fittings 30 from behind when the retainer 40 is at the full locking position. A slanted guide surface 51 is formed at the right end of the front surface of each second securing portion 50 and extends oblique both to the moving directions MD of the retainer 40 between the partial and full locking positions and to the inserting and withdrawing directions ID of the terminal fitting 30 (see FIGS. 19 to 22).

The front wall 42 engages the front end surfaces of the terminal fittings 30 from the front exactly in the opposite way of the second securing portions 50. Thus, the terminal fittings 30 contact the front wall 42 from behind when the terminal fittings 30 reach their proper insertion positions, and further forward movement of the terminal fittings 30 is prevented. A distance along forward and backward directions between the rear surface of the front wall 42 and the second securing portion 50 equals or slightly exceeds a distance between the front end surfaces of the terminal fittings 30 and rear engaging surfaces of the second engaging portions 34. The front wall 42 is at the front ends of the insertion paths of the terminal fittings 30 regardless of which position the retainer 40 is located at within its movable range between the partial locking position and the full locking position. Thus the terminal fittings 30 never fail to come into contact the front wall 42. Further, the rear surface of the front wall 42 is a substantially flat surface parallel with the moving directions of the retainer 40 between the partial locking position and the full locking position.

The front wall 42 has substantially rectangular tab holes 52 that are retracted leftward from the terminal fittings 30 in the housing 10 when the retainer 40 is at the partial locking position, but substantially face the terminal fittings 30 in the housing 10 when the retainer 40 is at the full locking position. The front wall 42 also has substantially rectangular jig insertion holes 53 that substantially face the locks 13 with respect to the transverse direction when the retainer 40 is at the partial locking position, but are retracted rightward from the locks 13 when the retainer 40 is at the full locking position.

The connector is assembled as follows. First, the retainer 40 is mounted at the partial locking position in the housing 10 such that the second securing portions 50 of the retainer 40 are retracted to the left of the insertion paths of the terminal fittings 30. Thus, the terminal fittings 30 can be inserted into the cavities 12. Further, the first securing portions 48 of the retainer 40 are retracted leftward from the locks 13 and the escaping spaces 47 are above the locks 13 while overlapping the deformation permitting spaces 17. Thus, upward resilient deformation of the locks 13 away from the insertion paths and into the deformation permitting spaces 17 is permitted.

The terminal fittings 30 are inserted into the corresponding cavities 12 in this state. The locks 13 interfere with the first engaging portion 33 on the upper wall of the rectangular tube 31 at an intermediate stage of the insertion locks 13. As a result, the locks 13 deform up in the deflection direction DD and enter the deformation permitting space 17 and the escaping space 33. The terminal fitting 30 eventually reaches its proper insertion position where the front end surface thereof abuts against the front wall 42 of the retainer 40. The lock 13 then resiliently restores and engages the first engaging portion 33 from behind, with the result that the terminal fitting 30 is locked by the lock 13.

The retainer 40 then is pushed from the partial locking position to the full locking position so that the second securing portions 50 of the retainer 40 engage the second engaging portions 34 of the terminal fittings 30 from behind. Thus, the retainer 40 locks the terminal fittings 30. As the retainer 40 is moved to the full locking position, the first securing portions 48 of the retainer 40 enter the deformation permitting spaces 17 to engage the locks 13 from above. As a result, the retainer 40 prevents the locks 13 from being displaced upward. In this way, the retainer 40 locks the terminal fittings 30 via the locks 13, and the terminal fittings 30 are locked triply and are prevented from coming out.

With the retainer 40 moved to the full locking position, the tab holes 52 of the front wall 42 face the terminal fittings 30 in the housing 10. When the connector is connected with the mating connector (not shown), the tabs (not shown) of the mating terminals enter the rectangular tubes 31 through the tab holes 52 to be connected with the terminal fittings 30.

The terminal fitting 30 can be withdrawn from the housing 10 by first moving the retainer 40 from the full locking position to the partial locking position. Thus, the locks 13 face the escaping spaces 47 and deformation is permitted. Additionally, the second securing portions 50 are retracted from the moving paths of the terminal fittings 30, and the jig insertion holes 53 face the locks 13. The lock 13 is lifted up by a narrow jig (not shown) inserted into the jig insertion hole 53 and disengaged from the first engaging portion 33 of the terminal fitting 30. The wire 36 or part of the terminal fitting 30 then is gripped to pull the terminal fitting 30 backward while this state is maintained.

In the connector of this embodiment, the retainer 40 is unitary both with the second securing portions 50 for locking the terminal fittings 30 from behind and with the front wall 42 for holding the terminal fittings 30 at their front-limit positions. Thus, a distance along forward and backward directions between the front wall 42 and the second securing portions 50 does not vary even if the retainer 40 shakes with respect to the housing 10. This prevents the terminal fittings 30 moving loosely in the inserting and withdrawing directions ID with respect to the retainer 40.

The front wall 42 is formed such that the terminal fittings 30 contact the front wall 42 regardless of where the retainer 40 is located between the partial locking position and the full locking position. Additionally, the rear surface of the front wall 42 is a substantially flat surface parallel with the moving directions MD of the retainer 40 between the partial locking position and the full locking position. Thus, the front wall 42 and the terminal fittings 30 already held in contact with the front wall 42 are in sliding contact with each other when the retainer 40 is moved form the partial locking position to the full locking position. Therefore, the front wall 42 and the terminal fittings 30 do not catch each other as the retainer 40 is moved.

Both the second securing portions 50 of the retainer 40 and the second engaging portions 34 of the terminal fittings 30 have slanted guide surfaces 35, 51 that extend oblique to the moving directions MD of the retainer 40. Thus, even if the terminal fittings 30 are displaced back from the proper insertion positions where they contact the front wall 42 (see FIG. 20), the terminal fittings 30 are pushed forward by the inclinations of the slanted guide surfaces 35, 51 held in contact with each other (see FIG. 21). Thus, the terminal fittings 30 reach the specified front-limit positions where they contact the front wall 42 (see FIG. 22). In other words, the retainer 40 and the terminal fittings 30 do not get caught by each other while the retainer 40 is pushed to the full locking position.

When the terminal fitting 30 is inserted properly, the first securing portion 48 enters the deformation permitting space 17 to prevent the lock 13 from being resiliently deformed in the direction DD and away from the terminal fitting 30, and the second securing portion 50 directly engages the terminal fitting 30. Thus, the first securing portion 48 and the second securing portion 50 lock the terminal fitting 30 securely. When the terminal fitting 30 is left insufficiently inserted, the first securing portion 48 of the retainer 40 interferes along the moving direction MD with the lock 13 that remains resiliently deformed and in the deformation permitting space 17 due to the interference with the first engaging portion 33. Additionally, the second securing portion 50 interferes along the moving direction MD with the rectangular tube 31 of the terminal fitting 30. This hinders movement of the mounting the retainer 40 into the housing 10, and the insufficiently inserted state of the terminal fitting 30 can be detected. The retainer 40 is provided with the first securing portions 48 and the second securing portions 50. Thus, even if either one of the locking portions is made smaller to make the connector smaller, the terminal fittings 30 can be locked securely and the insufficient insertion of the terminal fittings 30 can be detected.

Further, the arranging direction (vertical direction) of the terminal fittings 30, the locks 13 engageable with the terminal fittings 30, and the deformation permitting spaces 17 into which the locks 13 enter upon resilient deformation is substantially normal to the arranging direction of the terminal fittings 30, i.e. transverse direction, the deformation permitting spaces 17 are not narrowed even if the arrangement intervals of the terminal fittings 30 are narrowed and it is not necessary to thin the first securing portions 48 of the retainer 40 which are to be inserted into the deformation permitting spaces 17. Therefore, there is no possibility of reducing the locking function of the first securing portions 48 and the insufficient insertion detecting function due to the reduced arrangement intervals of the terminal fittings 30.

Furthermore, the mounting direction MD of the retainer 40 into the housing 10 is substantially parallel with the arranging direction (transverse direction) of the terminal fittings 30. Thus, the terminal fittings 30 may be arrayed at a plurality of stages with a plurality of terminal fittings 30 arranged side by side at each stage.

The retainer 40 mounted in the housing 10 is movable between the partial locking position where the insertion of the terminal fittings 30 is permitted and the full locking position where the terminal fittings 30 are locked. Thus, the retainer 40 can be mounted beforehand at the partial locking position in the housing 10 when the housing 10 and the retainer 10 are shipped to a location where the terminal fittings 30 are inserted. Therefore, parts management at the time of shipment can be simplified.

Figure 17:
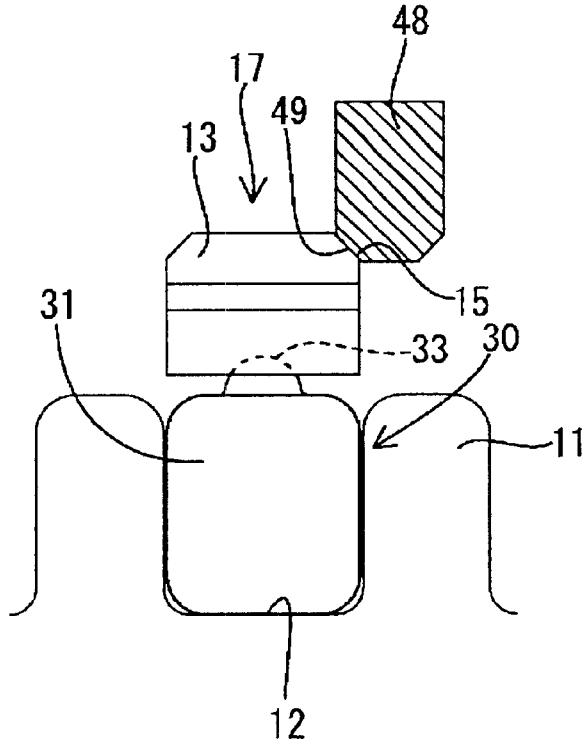
FIG. 17 is a horizontal section showing a positional relationship between the lock and the first securing portion where the retainer is displaced toward the full locking position and slanted guide surfaces are held in contact with each other during the resilient deformation of the lock.
Figure 18:
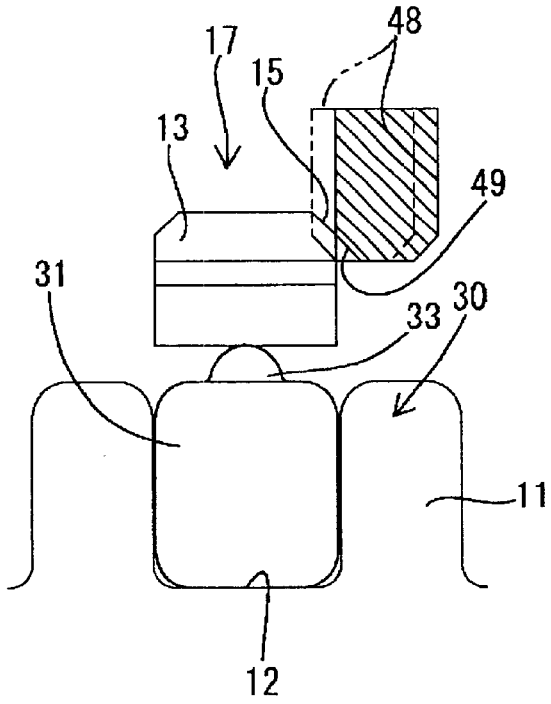
FIG. 18 a horizontal section showing a positional relationship between the lock and the first securing portion where the retainer is displaced toward the full locking position and the lock pushes the first securing portion toward the partial locking position by the inclinations of the slanted guides during the resilient deformation of the lock.
Figure 19:
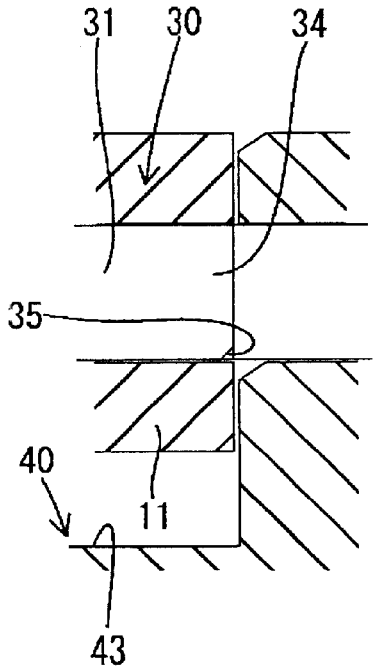
FIG. 19 is a fragmentary enlarged horizontal section showing the terminal fitting properly inserted and the retainer at the partial locking position.
Figure 20:
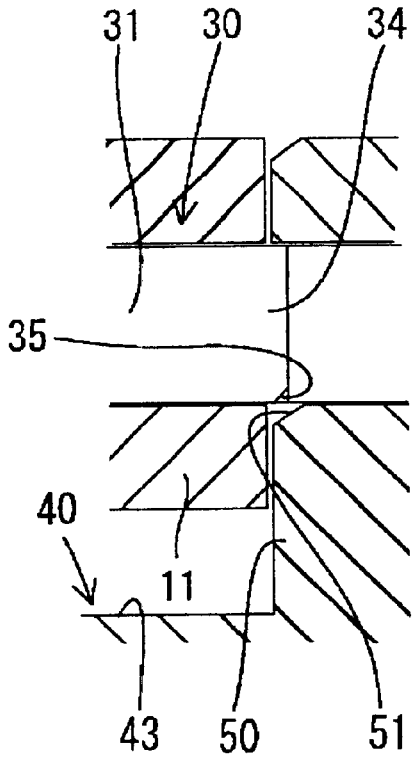
FIG. 20 is a fragmentary enlarged horizontal section showing a insufficiently inserted state of the terminal fitting.
Figure 21:
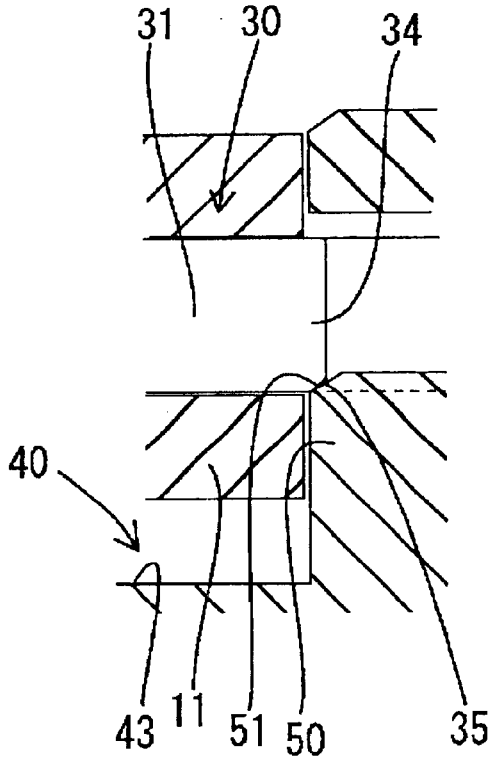
FIG. 21 is a fragmentary enlarged horizontal section showing a state where a slanted guide of the retainer contacts a slanted guide surface of the terminal fitting insufficiently inserted during the movement of the retainer from the partial locking position to the full locking position.
Figure 22:
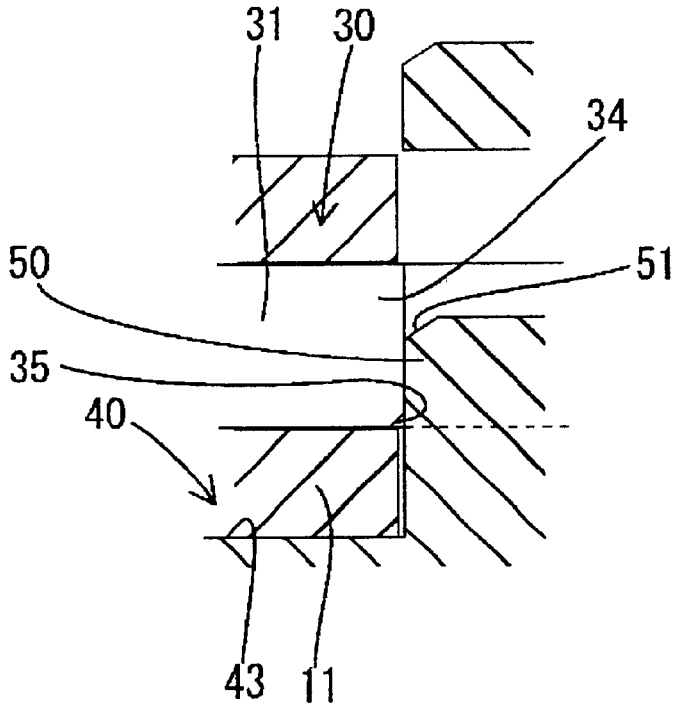
FIG. 22 is a fragmentary enlarged horizontal section showing the retainer pushing the insufficiently inserted terminal fitting to its proper insertion position by the inclinations of the slanted guides.

In the connector of this embodiment, both the locks 13 and the first securing portions 48 are formed with the slanted guide surfaces 15, 49 extending oblique to the resiliently deforming directions DD (vertical direction) of the locks 13 and oblique to the moving directions MD (transverse direction) of the retainer 40 between the partial and full locking positions. Accordingly, with the retainer 40 displaced toward the full locking position from the partial locking position, if portions of the first securing portions 48 enter the deformation permitting spaces 17 above the locks 13 (shown by solid line in FIG. 16), the slanted guide surfaces 15 of the locks 13 contact the slanted guide surfaces 49 of the first securing portions 48 as shown in FIG. 17 in the process of resiliently deforming the locks 13 upward by the interference with the terminal fittings 30. Thereafter, the first securing portions 48 of the retainer 40 are pushed by the inclinations of the slanted guide surfaces 15, 49 as the locks 13 are moved up, and the retainer 40 is moved from positions (shown by chain line in FIG. 18) above the locks 13 to proper partial locking positions (shown by solid line in FIG. 18) retracted sideways from the locks 13. In other words, the locks 13 are resiliently deformable into the deformation permitting spaces 17 while being held in sliding contact with the first securing portions 48 via the slanted guide surfaces 15, 49. As a result that the terminal fittings 30 can be inserted without any problem.

The main body 41 of the retainer 40 is formed with escaping spaces 47 for permitting the resilient deformation of the locks 13 by at least partly overlapping the deformation permitting spaces 17 when the retainer 40 is at the partial locking position. In other words, parts of the escaping space 47 and of the deformation permitting spaces 17 are at a substantially same longitudinal position when seen in the longitudinal direction of the housing 10. The escaping spaces 47 preferably are through holes that penetrate the retainer main body 41. Thus, the retainer main body 41 can be thinner as compared to a case where the escaping spaces 47 are in the form of recesses.

The escaping spaces 47 are through holes, and the first securing portions 48 between adjacent escaping spaces are beams. The beams have the opposite ends supported on the retainer main body 41 to ensure sufficient strength for the first securing portions 48.

The present invention is not limited to the above described and illustrated embodiment. For example, the following embodiments are also embraced by the technical scope of the present invention as defined by the claims.

Beside the following embodiments, various changes can be made without departing from the scope and spirit of the present invention as defined by the claims.

The retainer is movable between the partial locking position and the full locking position in the foregoing embodiment. However, the terminal fittings may be inserted with the retainer detached from the housing and the retainer may be assembled with the housing after the insertion of the terminal fittings according to the present invention.

The terminal fittings are held at their front-limit positions by being brought into contact with the front-stop while the retainer is at the partial locking position in the foregoing embodiment. However, the front-stop may not be in contact with the terminal fittings with the retainer at the partial locking position and may contact the front ends of the terminal fittings by moving the retainer to the full locking position according to the present invention.

The slanted guide surfaces are formed both on the securing portions of the retainer and on the second engaging portions of the terminal fittings in the foregoing embodiment. However, they may be formed either on the securing portions or on the second engaging portions.

Although the front ends of the terminal fittings contact the front-stop in the foregoing embodiment, projections may be formed on the outer surfaces of the terminal fittings for contact with the front-stop.

The retainer is mounted in the housing by being linearly moved in the direction MD substantially normal to the inserting direction ID of the terminal fittings. However, the retainer may be mounted at the partial locking position from the front of the housing (substantially parallel with the inserting direction ID of the terminal fittings) and moved sideways (substantially normal to the inserting direction of the terminal fittings) between the partial and full locking positions.

What is claimed is:

1. A connector, comprising:

a housing, at least one terminal fitting to be inserted into the housing from an insertion side, a lock formed in the housing for locking the terminal fitting in the housing, and a retainer to be assembled with the housing, wherein:

the retainer can engage the terminal fitting to prevent the terminal fitting from coming out with the terminal fitting inserted into the housing and the retainer assembled with the housing, and the retainer comprises at least one securing portion for securing the terminal fitting by engaging the terminal fitting from the insertion side, and an insertion-stop for holding the terminal fitting at a insertion-limit position thereof by bringing the terminal fitting into contact therewith from the insertion side, the retainer being movable between a first position where the securing portion is retracted from an insertion path for the terminal fitting and a second position where the securing portion engages the terminal fitting from the terminal insertion side, the retainer further being formed with at least one deformation preventing portion that engages the corresponding lock when the retainer is at the second position.

2. The connector of claim 1, wherein the retainer is formed unitarily with the securing portion.

3. The connector of claim 2, wherein the terminal fitting is to be inserted into the housing from behind, and wherein the insertion-stop is a front-stop with which the terminal fitting comes into contact from behind.

4. The connector of claim 1, wherein the insertion-stop is arranged such that the terminal fitting contacts the insertion-stop at all positions of the retainer between the first position and the second position.

5. The connector of claim 1, wherein the insertion-stop has a substantially flat surface substantially parallel with moving directions of the retainer between the first position and the second position.

6. The connector of claim 1, wherein at least one of the securing portion and an engaging portion of the terminal fitting with which the securing portion is to be engaged is formed with a slanted guide surface oblique to the moving directions of the retainer between the first position and the second position.

7. The connector of claim 1, wherein the retainer is in sliding contact with the housing and the terminal fittings when the retainer is moved between the first position and the second position.

8. The connector of claim 1, wherein at least one of the deformation preventing portion and the lock is formed with a slanted guide portion extending oblique to resiliently deforming directions of the lock and moving directions of the retainer between the first position and the second position.

* * * * *